US007255022B1

(12) United States Patent
Rivera

(10) Patent No.: US 7,255,022 B1
(45) Date of Patent: Aug. 14, 2007

(54) COMBINATION CORK EXTRACTOR AND VACUUM SEALER TOOL

(76) Inventor: Adrian Rivera, P.O. Box 370861, Las Vegas, NV (US) 89137

( * ) Notice: Subject to any disclaimer, the term of this patent is extended or adjusted under 35 U.S.C. 154(b) by 83 days.

(21) Appl. No.: 11/253,055

(22) Filed: Oct. 17, 2005

Related U.S. Application Data

(60) Provisional application No. 60/522,579, filed on Oct. 16, 2004.

(51) Int. Cl.
*B67B 7/08* (2006.01)
*B65D 51/16* (2006.01)
*B25F 1/00* (2006.01)

(52) U.S. Cl. ..... 81/3.2; 81/3.48

(58) Field of Classification Search ..... 81/3.2, 81/3.48; 7/151
See application file for complete search history.

(56) References Cited

U.S. PATENT DOCUMENTS

| | | | | |
|---|---|---|---|---|
| 2,436,849 | A | 3/1948 | Billetter | |
| 2,534,504 | A | 12/1950 | Engstrom | |
| 3,084,823 | A | 4/1963 | Reichstein | |
| 4,249,583 | A | 2/1981 | Lundbladh | |
| 4,583,925 | A | 4/1986 | Hawkins | |
| 4,684,033 | A | 8/1987 | Marcus | |
| 4,763,803 | A | 8/1988 | Schneider | |
| 4,911,314 | A | 3/1990 | Schneider | |
| 4,998,633 | A | 3/1991 | Schneider | |
| 5,012,703 | A * | 5/1991 | Reinbacher | 81/3.29 |
| 5,031,785 | A | 7/1991 | Lemme | |
| 5,489,044 | A | 2/1996 | Ophardt | |
| 6,282,985 | B1 | 9/2001 | Tseng | |
| 6,622,595 | B1 | 9/2003 | Federighi | |
| 6,941,839 | B1 * | 9/2005 | Syu | 81/3.2 |
| 2003/0033907 | A1 * | 2/2003 | Lian | 81/3.2 |
| 2005/0076741 | A1 * | 4/2005 | Chan | 81/3.2 |

OTHER PUBLICATIONS

Smarthome On-Line Catalog showing "Turning Leaf" Air Pressure Cork Popper, dated Feb. 14, 2006, www.smarthome.com/91333.html.

* cited by examiner

*Primary Examiner*—David B. Thomas
(74) *Attorney, Agent, or Firm*—Knobbe, Martens, Olson & Bear LLP

(57) ABSTRACT

A combination cork extractor and vacuum sealer device is provided. The device is a compact, unitary tool that performs the dual function of a cork extractor and vacuum sealer for corked wine or champagne bottles. The device generally includes an elongated housing having an air passageway therein, a piston assembly that slidably engages with the inner walls of the housing, a needle assembly for injecting air into a cork bottle, a sealing assembly that operates in conjunction with a stopper to remove air from a bottle, and a plurality of one-way valves that regulate the direction of air flow inside the device. The needle assembly includes a hollow needle and an opening formed adjacent a second end of the needle. The sealing assembly includes a resilient member configured to sealingly engage with a stopper, and a plurality of openings formed in an exterior surface and fluid communication with one of the one-way valves.

11 Claims, 5 Drawing Sheets

COMBINATION CORK EXTRACTOR AND VACUUM SEALER TOOL

CROSS-REFERENCE TO RELATED APPLICATIONS

This application claims the benefit of U.S. Provisional Application No. 60/522,579, filed Oct. 16, 2004, which is hereby incorporated by reference in its entirety.

BACKGROUND OF THE INVENTION

1. Field of the Invention

This invention relates generally to a tool for opening and closing bottles containing beverages such as wine or champagne, more particularly, to a multi-function tool designed to facilitate extracting cork from beverage bottles and preserving beverage in partially consumed bottles.

2. Description of the Related Art

Bottles containing fermented or carbonated beverages such as wine or champagne are typically closed and sealed by a cork stopper made of natural or synthetic materials. Tools such as corkscrews have been developed for extracting the cork stopper from such bottles prior to consumption. While corkscrews are commonly used for removing corks from wine bottles, there are drawbacks associated with conventional corkscrews. If the coil of the corkscrew is not centered properly while being inserted into the cork, the corkscrew can cause the cork to chip and disintegrate. Moreover, insertion of the corkscrew into the cork is not a simple process as it requires one to apply force to cause the metal coil to penetrate into the cork all the while making sure that the coil is centered relative to the cork. In addition to the corkscrew, another type of known cork extractor operates by injecting air via a needle-like device through the cork into the bottle. The increased air pressure inside the bottle would in turn eject the cork. While the air pressure based cork extractors are easier to operate as compared to the corkscrew, they are typically single-function bar accessory tools that must be purchased individually and take up separate storage space.

Once the cork is removed, the wine is exposed to oxygen in the air and thus becomes susceptible to oxidation. It is generally known that prolonged exposure to oxygen can detrimentally affect the quality and flavor of the wine. Wine that remains in a partially consumed bottle can quickly deteriorate in taste even if the bottle is recorked. This is often due to the wine being oxidized by oxygen that entered the bottle when the cork was removed. In an effort to preserve partially consumed wine, various vacuum sealers have been developed to remove air from the headspace of the bottle after recorking so as to minimize oxidation of the wine. The conventional vacuum sealer assemblies typically utilize a hand pump working in conjunction with a specially designed stopper fitted with a one-way valve to evacuate air from the bottle. The hand pump usually operates by moving a piston through the bore of a cylinder to evacuate air from the bottle. The piston itself also acts as a release valve to adjust the pressure differential inside the cylinder so that the piston can be easily moved back and forth in the bore.

The conventional vacuum sealers direct air to flow in a reverse direction as that of the aforementioned air pressure based cork extractor. The vacuum sealer operates to pump air out of the wine bottle while the air pressure based cork extractor functions to introduce air into the bottle to pressurize the bottle. The reversed directions of air flow would typically require separate air passageways and pump systems, which make it not feasible to combine both tools into a single, compact device. As such, these tools are usually configured as separate, individual units that would have to be purchased and stored separately.

From the foregoing, it will be appreciated that there is a need for a compact, unitary, multi-function device for opening and closing wine, champagne, or other beverage bottles. To this end, there is a particular need for a single, compact tool that can effectively serve the functions of both a cork extractor and a vacuum sealer.

SUMMARY OF THE INVENTION

In one aspect, the preferred embodiments of the present invention provide a combination cork extractor and vacuum sealer device. The device comprises a housing, preferably a cylindrical housing, wherein the housing has an inner wall and an air passageway defined by the inner wall, and a piston assembly coupled to one of the housing. Preferably, the piston assembly slidably engages with the inner wall of the housing so as to move air along the air passageway. The device further includes a sealing assembly coupled to the housing, wherein the sealing assembly is in fluid communication with the air passageway. Preferably, the sealing assembly has a one-way valve configured to permit air to flow into the air passageway in the housing. The device further comprises an air injector assembly coupled to the housing, wherein the air injector assembly is in fluid communication with the air passageway of the housing. Preferably, the air injector assembly has an opening and a one-way valve configured to permit air to flow from the air passageway to the opening. In one embodiment, the air injector assembly comprises a needle configured to be inserted into a cork. In another embodiment, the sealing assembly comprises a resilient member adapted to sealingly engage with a stopper. In a preferred embodiment, the piston is configured to extend into the air passageway to drive air therein through the one-way valve of the air injector assembly and through the opening of the air injector assembly. In another embodiment, the piston is configured to retract from the air passageway to draw external air through the sealing assembly through the one-way valve of the sealing assembly and into the air passageway in the housing. In yet another embodiment, the piston assembly comprises a piston which sealingly engages with the inner walls of the housing so as to substantially inhibit air in the air passageway from passing from one side of the piston to the other.

In another aspect, the preferred embodiments of the present invention provide a combination cork extractor and air evacuator device for wine bottles. The device comprises an elongated housing having an air passageway therein, wherein the housing has a first and a second opening. The device further includes a one-way valve positioned adjacent the first opening of the housing, wherein the one-way valve is in fluid communication with the air passageway. Preferably, the one-way valve permits air to flow from the air passageway through the opening to outside of the housing and the one-way valve substantially prevents external air from entering the air passageway through the first opening. The device further includes a second one-way valve positioned adjacent the second opening of the housing, wherein the second one-way valve is in fluid communication with the air passageway. Preferably, the second one-way valve permits external air to flow into the air passageway and the second one-way valve substantially prevents air in the air passageway to exit the housing through the second opening. In one embodiment, the device further comprises a piston assembly, wherein the piston assembly is coupled to the housing and can be extended and retracted through the air passageway. In another embodiment, the device further comprises a needle assembly coupled to the one-way valve, wherein the needle assembly is hollow and is in fluid communication with ambient air. In yet another embodiment, the device further comprises a sealing assembly coupled to the second one-way valve, wherein the sealing assembly is in fluid communication with ambient air.

DETAILED DESCRIPTION OF THE PREFERRED EMBODIMENT

Figure 1:
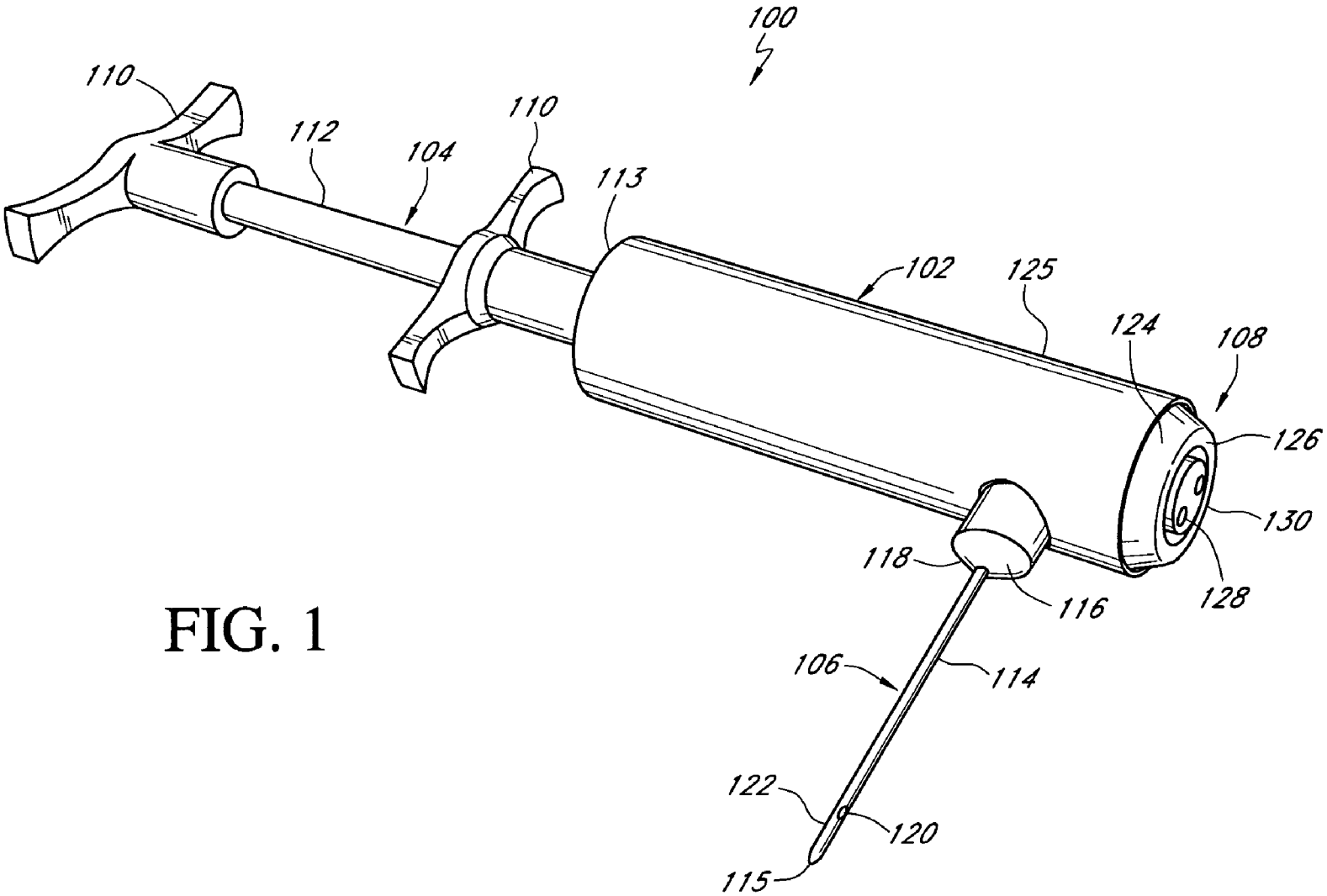
FIG. 1 is a perspective view of a combination cork extractor and vacuum sealer device of a preferred embodiment of the present invention.

A combination cork extractor and vacuum sealer device 100 of a preferred embodiment of the present invention is illustrated in FIG. 1. As shown in FIG. 1, the device 100 generally includes an elongated housing 102 having an air passageway therein, a piston assembly 104 that slidably engages with the inner walls of the housing 102, a needle assembly 106 for perforating the cork and injecting air into a corked bottle, a vacuum sealing assembly 108 that operates in conjunction with a stopper to remove air from the headspace of a bottle, and a first and a second one-way valve 116, 124 that regulate the direction of air flow inside the device.

The elongated housing 102 has a generally cylindrical shape and can be made of a variety of different materials such as metals, plastics, or composite materials. Air can be moved in and out of the air passageway in the housing 102 by way of the piston assembly 104 and the one-way valves 116, 124 in a manner to be described in greater detail below. The piston assembly 104 generally a piston (not shown) positioned inside the air passageway, a handle portion 110, and a rod 112 coupled to the handle portion 110 and the piston. The handle portion 110 can be maneuvered to extend or retract the piston through the air passageway to move air therethrough. In a preferred embodiment, the piston sealingly engages with the inner walls of the air passageway so that air in the air passageway is substantially inhibited from passing from one side of the piston to the other. As such, substantially no air flows past the piston when the piston is either retracted or extended configuration in the air passageway. Thus, unlike conventional hand pump type of cork extractors or vacuum sealers, the piston assembly does not act as a release valve.

As FIG. 1 further shows, the needle assembly 106 is coupled to the housing 102, and preferably extends orthogonally from an end 125 of the housing that is located opposite from the end 113 which the piston handle 110 is located. The assembly 106 comprises a hollow needle 114 having an air passageway therein and a perforation tip 115 configured to facilitate insertion of the needle into a cork. The needle assembly 106 also has an opening or air outlet 120 formed adjacent a distal end 122 of the hollow needle 114. The opening 120 is configured to be in fluid communication with the air passageway in the needle 114. As will be described in greater detail below, the first one-way valve 116 is positioned between the air passageway in the housing and the air passageway with the hollow needle in a manner so that it is in fluid communication with both. Preferably, the one-way valve 116 permits air to flow from the air passageway inside the housing into the air passageway in the hollow needle, but substantially inhibits reverse air flow from the hollow needle back into the air passageway of the housing. As will be described in greater detail below, the needle assembly 106 operates in conjunction with the piston assembly 104 to drive air into a corked bottle such that the accumulated air pressure would lift the cork out of the bottle.

Figure 2:
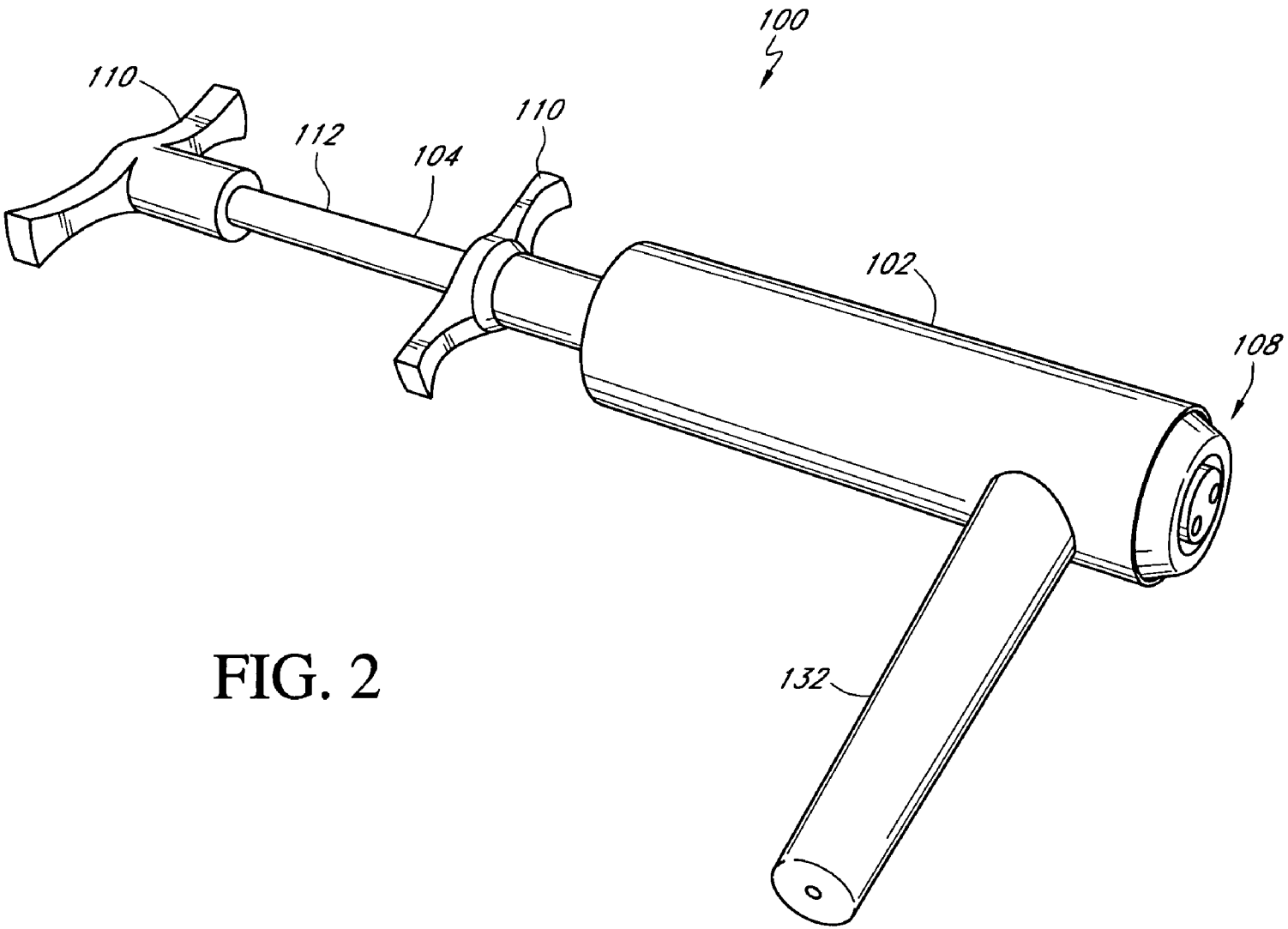
FIG. 2 is a perspective view of the combination cork extractor and vacuum sealer device of FIG. 1 with a protective cover placed over the needle assembly.

As FIG. 1 further shows, the sealing assembly 108 comprises a resilient member 126 configured to sealingly engage with a stopper, and a plurality of openings 128 formed in an exterior surface 130 of the sealing assembly 108. As will be described in greater detail below, the second one-way valve 124 is positioned between the air passageway in the housing and the openings in the sealing assembly so as to be in fluid communication with both. The second one-way valve 124 is configured to permit air external to the device to flow through the openings 128 into the air passageway in the housing, but substantially inhibits air in the air passageway to flow out through the openings 128. As will be described in greater detail below, the sealing assembly 108 operates in conjunction with the piston assembly 104 to pull air into the device. The first and second one-way valves 118, 124 described above can be selected from a number of commonly known designs. In some embodiments, the device 100 further includes a protective cover 132 that is detachably positioned over the needle assembly as shown in FIG. 2. The protective cover 132 covers the needle 114 when the device is not in use. In another embodiment, a coating such as Teflon® or the like can be applied to the exterior surface of the needle to facilitate insertion into the cork.

Figure 3:
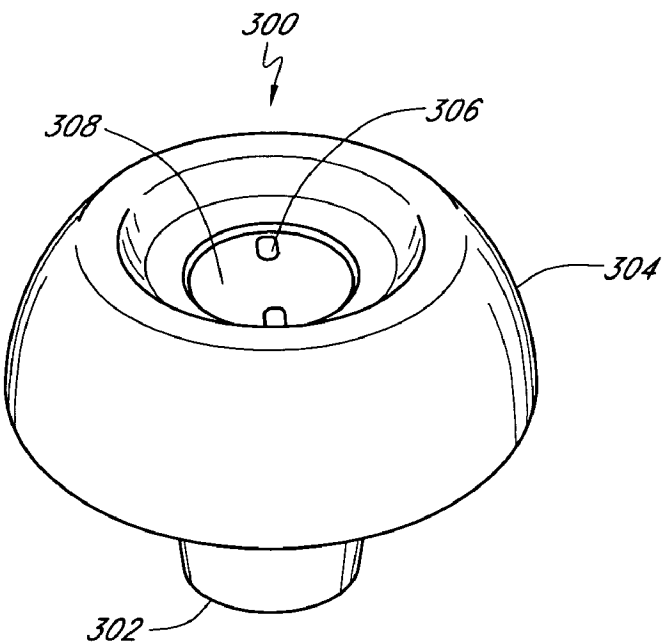
FIG. 3 is a perspective view of a stopper assembly of a preferred embodiment that can be used in conjunction with the device of FIG. 1 to evacuate air from a bottle.

FIG. 3 illustrates a stopper assembly 300 of a preferred embodiment used in conjunction with the sealing assembly 108 of the device 100 to preserve partially consumed bottles of wine. As shown in FIG. 3, the stopper assembly 300 has a generally circular shape and is configured to mount adjacent to the neck of a bottle, preferably a wine bottle. The assembly 300 comprises a hollow stem 302 configured to extend into the neck of a bottle, an annular skirt 304 above the stem 302 configured to fit over the lip of the bottle opening. As also shown in FIG. 3, a plurality of openings 306 are formed on an upper surface 308 of the stopper. In a preferred embodiment, a one-way valve (not shown) is positioned between the openings 306 and the stem 302. As will be described in greater detail below, the openings 306 in the stopper assembly 300 are configured to align and become in fluid communication with the openings formed in the sealing assembly of the device.

Figure 4:
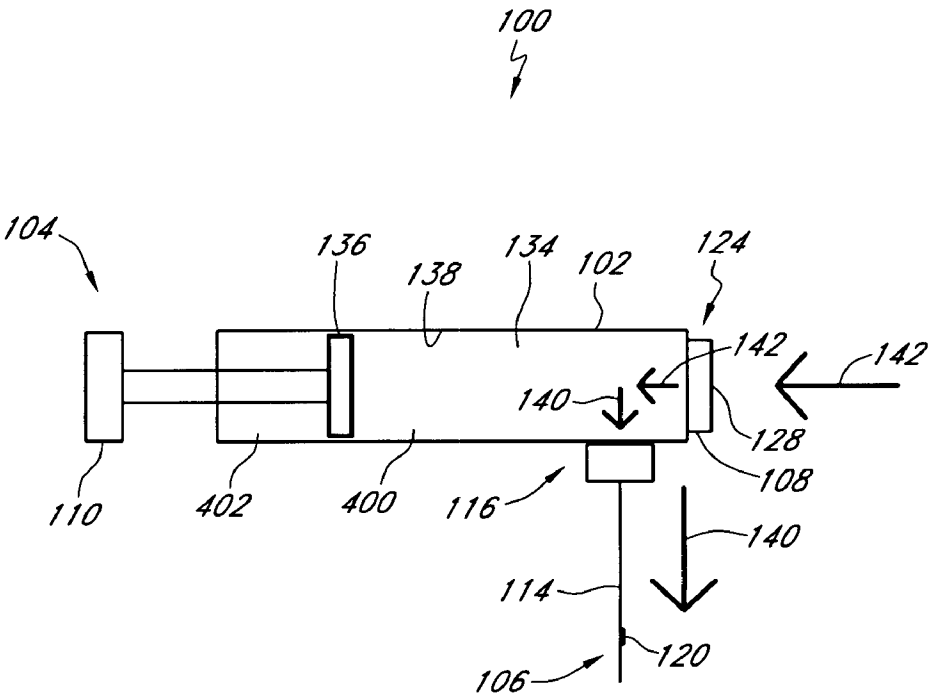
FIG. 4 is a schematic cross-sectional view of the combination cork extractor and vacuum sealer device of FIG. 1.

FIG. 4 schematically illustrates a cross-sectional area of the combination cork extractor and vacuum sealer device 100. As shown in FIG. 4, the piston assembly 104 is coupled to the housing 102 for extension and retraction through the air passageway 134. The piston portion 136 is formed to slidably fit into the air passageway 134 of the housing 102 and move air through the passageway as the handle 110 of the piston assembly is pushed and pulled in an axial direction. In one preferred embodiment, the piston 136 sealingly engages with the inner walls 138 of the air passageway 134 so that air cannot pass from one side 400 of the air passageway to another 402 through the piston 136. As such, the piston 136 does not function as a valve.

As also shown in FIG. 4, the air passageway 134 is in fluid communication with the needle assembly 106 via the first one-way valve 116. The first one-way valve 116 is configured to permit air to flow in the direction 140 from the air passageway 134 of the housing to the needle assembly 106. As the piston 136 is pushed into housing, air is pushed through the air passageway 134 in the housing 102, through the one-way valve 116 in the needle assembly, through the hollow needle body 114, and out the opening 120 in the needle assembly. Preferably, the air passageway 134 is also in fluid communication with the sealer assembly 124 via the second one-way valve 124. The second one-way valve 124 is configured to permit air to flow in the direction 142 from the exterior openings 128 of the sealing assembly 108 into the air passageway 134. As the piston 136 is retracted from the housing 102, external air is drawn through the openings 128 of the sealer assembly into the air passageway 134 to increase the air pressure on the side 400 of the air passageway so as to facilitate retraction of the piston 136.

Figure 5:
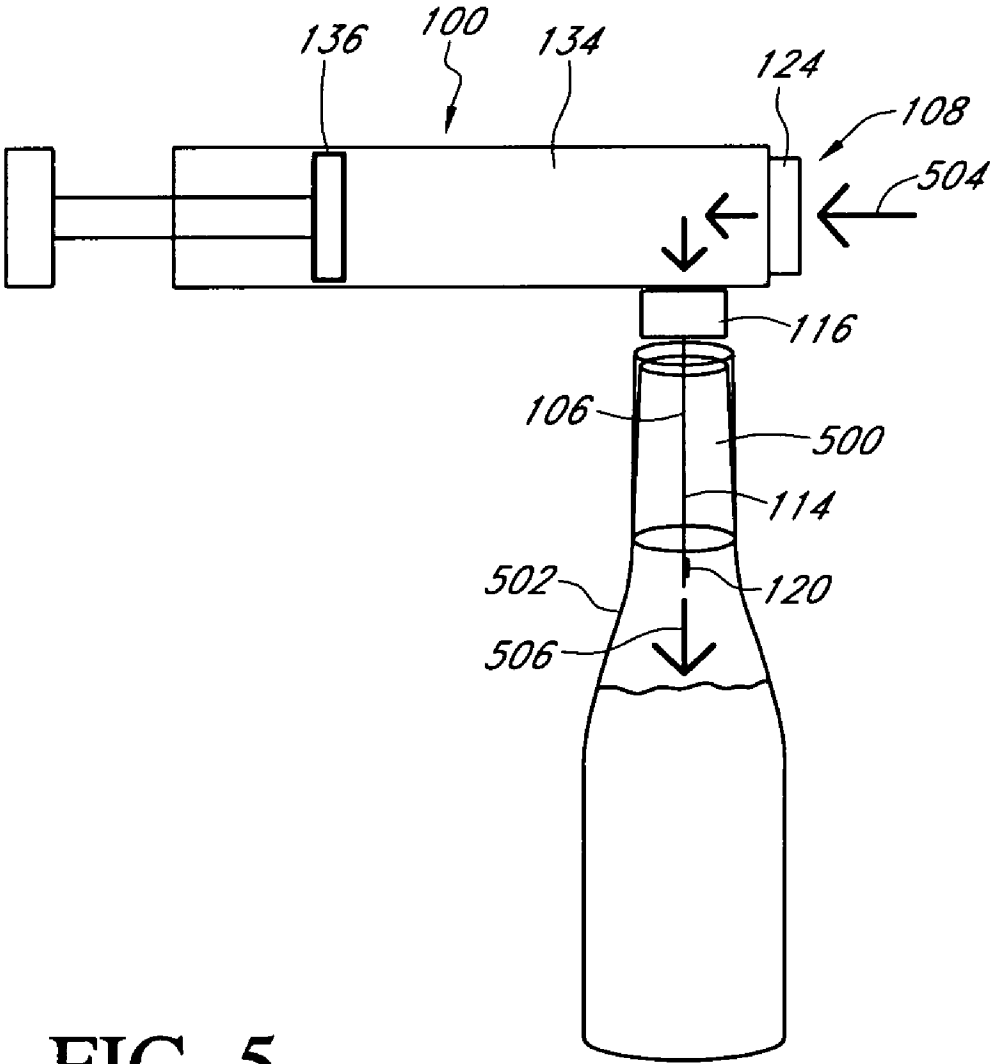
FIG. 5 is a schematic illustration of the manner in which the device of FIG. 1 can be used to extract the cork from a beverage bottle.

FIG. 5 schematically illustrates the manner in which the device 100 can be used to extract a cork 500 from a beverage bottle 502 such as a wine bottle. As shown in FIG. 5, the needle 114 is inserted into the upper surface of the cork 500 and extended through the cork 500 until the opening 120 in the needle is exposed. In operation, the piston 136 is extended into the housing, pushing the air inside the housing 134 through the first one-way valve 116 through the hollow needle 114 and out the opening 120. Air 506 is thus injected into the headspace of the bottle 502, thereby creating a pressure built-up in the headspace of the bottle. The piston 136 is then retracted to draw additional air 504 into the housing 134 through the second one-way valve 124. The piston 136 can then be extended into the housing 134 to push additional air through the first one-way valve 116, into the bottle 502. The air pressure built up inside the bottle will cause the cork to be ejected.

Figure 6:
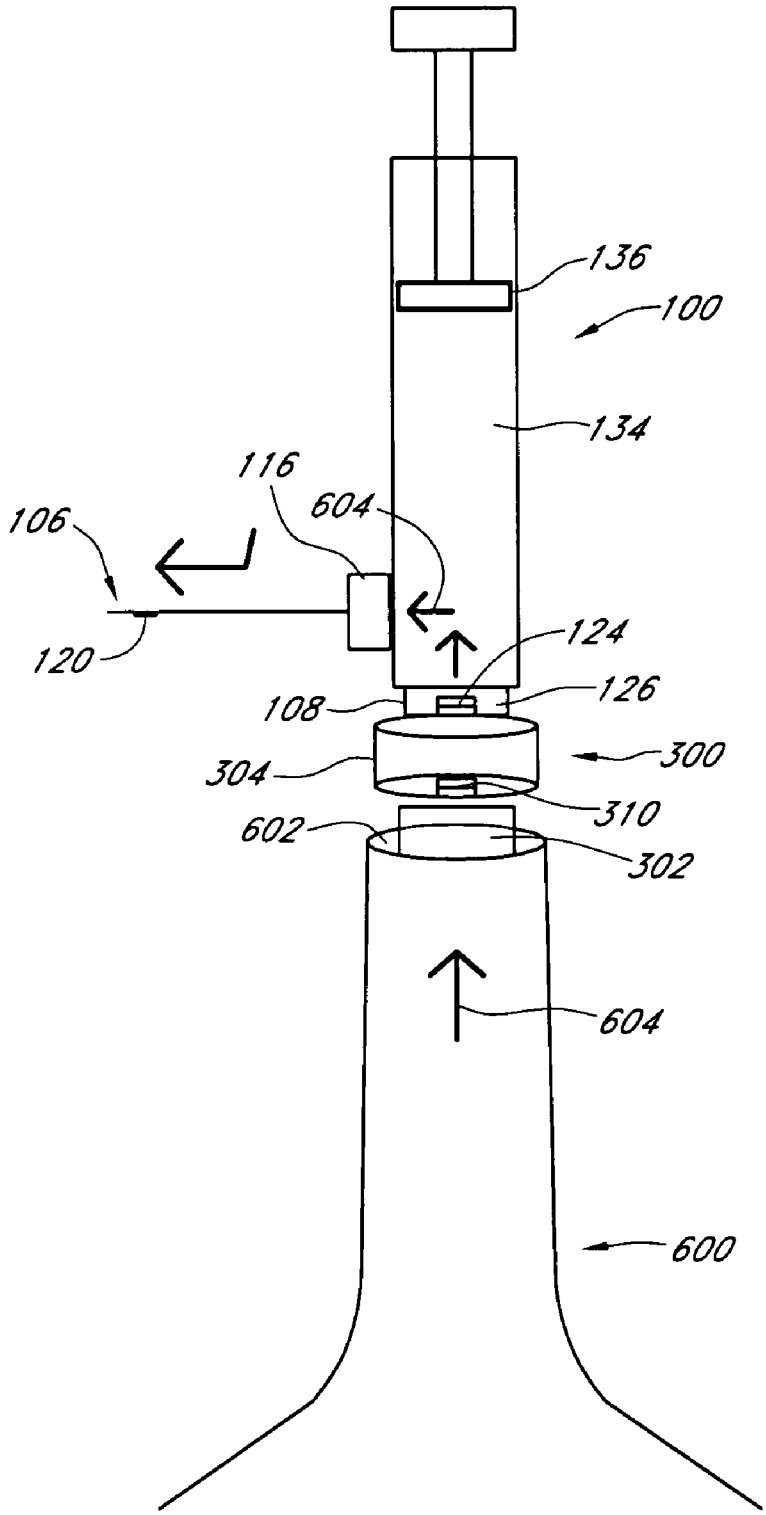
FIG. 6 schematically illustrates the manner in which the device can be used to evacuate air from a partially consumed wine bottle.

FIG. 6 schematically illustrates the manner in which the device 100 can be used to remove air from the headspace of a partially consumed wine bottle 600. As shown in FIG. 6, the stopper assembly 300 is positioned over the bottle opening 602 with the stem 302 of the stopper assembly 300 inserted into the bottle neck. The device 100 is positioned over the stopper assembly 300 in a manner such that the resilient member 126 of the sealing assembly 108 sealingly engages with the annular skirt 304 of the stopper assembly 300. The sealing assembly 108 is in fluid communication with the stopper assembly 300 via their respective openings 128, 306. To evacuate air 604 from the headspace of the bottle, the piston 136 is retracted from the housing 134 creating a pressure differential so as to draw air 604 from the bottle 600 through the one-way valve 310 of the stopper assembly and through the second one-way valve 124 of device. Accumulated air 604 inside the air passageway is released by flowing through the first one-way valve 116 in the needle assembly 106, out thorough the opening 120 in the needle. The air passageway provides an evacuation chamber into which air from the bottle headspace is drawn as the piston is moved.

Advantageously, the combination cork extractor and vacuum sealing device of the preferred embodiments of the present invention provide a compact tool that can be used to inject air into a wine bottle and also to evacuate air from the bottle. The device utilizes a piston, a single air passageway in conjunction with a plurality of one-way valves to cause the air to flow in reverse directions depending on the function. It will be appreciated that the device of the preferred embodiments can be applied to a variety of different types of corked beverage bottles, including wine, champagne and the like.

Although the foregoing description of some of the preferred embodiments of the present invention has shown, described and pointed out the fundamental novel features of the invention, it will be understood that various omissions, substitutions, and changes in the form of the detail of the system, apparatus, and methods as illustrated as well as the uses thereof, may be made by those skilled in the art, without departing from the spirit of the invention. Consequently, the scope of the present invention should not be limited to the foregoing discussions, where claim language carries an ordinary meaning as in customary usage and not by special definition unless specifically stated as providing a definition.

What is claimed is:

1. A combination cork extractor and vacuum sealer device, comprising:

a housing, said housing having an inner wall and an air passageway defined by said inner wall;

a piston assembly coupled to one end of said housing, said piston assembly slidably engages with the inner wall of said housing so as to move air along said air passageway;

a sealing assembly coupled to said housing, wherein the sealing assembly is in fluid communication with the air passageway, said sealing assembly having a one-way valve configured to permit air to flow into the air passageway in said housing; and an air injector assembly coupled to said housing, wherein the air injector assembly is in fluid communication with the air passageway of the housing, said air injector assembly having an opening and a one-way valve configured to permit air to flow from the air passageway to the opening.

2. The device of claim 1, wherein the air injector assembly comprises a needle assembly configured to be inserted into a cork.

3. The device of claim 1, wherein the sealing assembly comprises a resilient member adapted to sealingly engage with a stopper.

4. The device of claim 1, wherein the housing comprises a cylindrical housing.

5. The device of claim 1, wherein the piston is configured to extend into the air passageway to drive air therein through the one-way valve of the air injector assembly and through the opening of the air injector assembly.

6. The device of claim 1, wherein the piston is configured to retract from the air passageway to draw external air through the sealing assembly through the one-way valve of the sealing assembly and into the air passageway in the housing.

7. The device of claim 1, wherein the piston assembly comprises a piston which sealingly engages with the inner walls of the housing so as to substantially inhibit air in the air passageway from passing from one side of the piston to the other.

8. A combination cork extractor and air evacuator device for wine bottles, comprising:

an elongated housing having an air passageway therein, wherein the housing has a first and a second opening;

a one-way valve positioned adjacent the first opening of the housing, said one-way valve is in fluid communication with said air passageway, wherein the one-way valve permits air to flow from said air passageway through the opening to outside of the housing, wherein the one-way valve substantially prevents external air from entering the air passageway through the first opening; and a second one-way valve positioned adjacent the second opening of the housing, said second one-way valve is in fluid communication with said air passageway, wherein the second one-way valve permits external air to flow into the air passageway, wherein the second one-way valve substantially prevents air in the air passageway to exit the air passageway through the second opening.

9. The device of claim 8, wherein the device further comprises a piston assembly, said piston assembly is coupled to the housing and can be extended and retracted through the air passageway.

10. The device of claim 8, wherein the device further comprises a needle assembly coupled to the one-way valve, wherein said needle assembly is hollow and is in fluid communication with ambient air.

11. The device of claim 8, wherein the device further comprises a sealing assembly coupled to the second one-way valve, wherein said sealing assembly is in fluid communication with ambient air.

* * * * *